United States Patent [19]

Gates et al.

[11] Patent Number: 4,768,788

[45] Date of Patent: Sep. 6, 1988

[54] SAILING VOYAGE GAME

[76] Inventors: Thomas A. Gates, 59 Denison Rd., Schenectady, N.Y. 12309; Kevin S. Young, Mallview Apts., 7 N. Red Mill Rd., Rensselaer, N.Y. 12144

[21] Appl. No.: 710,320

[22] Filed: Mar. 11, 1985

[51] Int. Cl.[4] ..... A63F 3/00

[52] U.S. Cl. ..... 273/246; 273/252; 273/284

[58] Field of Search ..... 273/296, 244, 252, 251, 273/254, 253, 284

[56] References Cited

U.S. PATENT DOCUMENTS

| | | | |
|---|---|---|---|
| 2,455,519 | 12/1948 | Powers | 273/246 |
| 2,757,933 | 8/1956 | Gilmore | 273/254 |
| 3,099,451 | 7/1963 | Newhouse | 273/253 |
| 3,874,671 | 4/1975 | Smith | 273/254 |
| 4,082,289 | 4/1978 | Merritt | 273/246 |
| 4,244,580 | 1/1981 | Hoyles | 273/282 R |

FOREIGN PATENT DOCUMENTS

| | | | |
|---|---|---|---|
| 1501739 | 10/1967 | France | 273/246 |
| 567020 | 1/1945 | United Kingdom | 273/246 |
| 889725 | 2/1962 | United Kingdom | 273/246 |
| 2030875 | 4/1980 | United Kingdom | 273/254 |

*Primary Examiner*—Richard C. Pinkham
*Assistant Examiner*—Benjamin Layno
*Attorney, Agent, or Firm*—Schmeiser, Morelle & Watts

[57] ABSTRACT

In a sailing game, a number of movable land masses each having a habor therein for placement upon a game board. At least two types of sailing vessels, each having different navigational abilities when moving over the game board. Wind speed and direction indicators for determining the possible movements of the vessels during each turn, wherein all vessels on the game board, and not within a harbor, must be subject to the indicators. Facility and buoy cards acquired by each player allow the player to alter the effects of the wind speed and direction indicators upon his vessel. The winner being the first individual to navigate his vessel from the home harbor to all of the other harbors and return back to the home harbor.

7 Claims, 5 Drawing Sheets

SAILING VOYAGE GAME

FIELD OF THE INVENTION

This invention relates to a sailing game. More specifically, this invention relates to a competitive sailing game wherein two or more players travel about a course, stopping at preselected harbors and race to a finish line.

BACKGROUND AND OBJECTS OF THE INVENTION

Sailing is a popular sport and activity in many countries throughout the world. It is not surprising, therefore, that games which simulate sailing are quite numerous. Generally, these sailing games attempt to accurately simulate sailboat races. In order to accomplish this, they transfer to the game many of the variables which exist in sailboat racing.

In order to simulate sailboat racing, it has been common for games to include features such as movable sailing hazards and wind shift indicators. Other features such as buoys which set the race course to be followed and wind lull areas are also common. In this way, these games have covered many of the possible variations encountered during sailboat racing. However, our experiences with sailing indicate that only a small number of those individuals who sail actively pursue racing. In fact, the large majority of those individuals who sail do so with families or friends and generally sail to specific points of interest such as beaches, harbors, or waterfront restaurants.

Thus, while prior sailing games attempt to simulate sailboat racing conditions, they fail to account for the events and circumstances encountered during a sailing voyage. For this reason, games which only simulate a sailboat race do not relate to the experiences encountered by the vast majority of sailors.

Another important disadvantage with games that relate primarily to sail boat racing is that they fail to teach players important attitudes and rules of safety which are associated with a sailing voyage. This means that the player not intimately familiar with sailing develops a one-sided view which teaches about only one area of the sailing experience.

It is therefore an object of this invention to provide a new and improved sailing game which simulates a sailing voyage.

Another object of this invention is to provide a sailing game which gives the players an appreciation for the risks involved in a sailing outing.

Another object of this invention is to provide a sailing game which develops positive and safe attitudes about sailing.

Another object of this invention is to provide a new and improved sailing game which allows the player to use sailing strategy in order to win.

Still another object of this invention is to provide a sailing game wherein the voyage to be undertaken can be preset by the players in order to provide unlimited playing variations.

Yet another object of this invention is to provide a sailing game wherein the length of the game can be varied by the players by varying the game board playing pattern.

Another object of this invention is to provide an improved sailing game which is sufficiently adaptable so as to be challenging and enjoyable to a wide variety of ages.

Objects and advantages of the invention are set forth in part herein and in part will be obvious herefrom, or may be learned by practice with the invention, the same being realized and attained by means of the instrumentalities and combinations pointed out in the appended claims.

The invention consists in novel parts, constructions, arrangements, combinations and improvements herein shown and described.

SUMMARY OF THE INVENTION

It has been found that the objects of this invention may be realized by forming a game board with movable land masses, each of the land masses having at least one harbor therein which must be visited during the play of the game. One of two different types of sailing boats, having different sailing capabilities giving each boat certain advantages under specific sailing conditions, are chosen by the players prior to the start of the game. Facility cards, which simulate typical sailing equipment such as anchors and radar are available in limited numbers at each of the harbors. However, playing time must be forfeited in order to obtain these facility cards which make the remaining voyage safer.

The sailing game of the subject invention provides a remarkably accurate simulation of a sailing voyage. The choices made during the game parallel choices made during typical voyages and give the players an appreciation for the possible consequences of those choices. Consequently, the subject invention is more than just a race from start to finish in that many features of the game set up a balancing of speed and safety which must be weighed by the players in making their decisions as to what actions will provide the quickest and safest voyage. It will be understood that the foregoing general description and the following detailed description as well are exemplary and explanatory of the invention but are not restrictive thereof. Thus, while the subject invention contains many important features, the scope of the invention is intended to be limited only by the appended claims.

The accompanying drawings, referred to herein and constituting a part hereof, illustrate preferred embodiments of the invention, and together with the description serve to explain the principles of the invention.

BRIEF DESCRIPTION OF THE DRAWINGS

Of the drawings:

FIG. 1 is a perspective view of the game board and a perspective view of a playing pattern to be placed on the game board, the view showing the games paraphenalia such as land masses, shoals and the like;

DETAILED DESCRIPTION OF THE DRAWINGS

Figure 1:
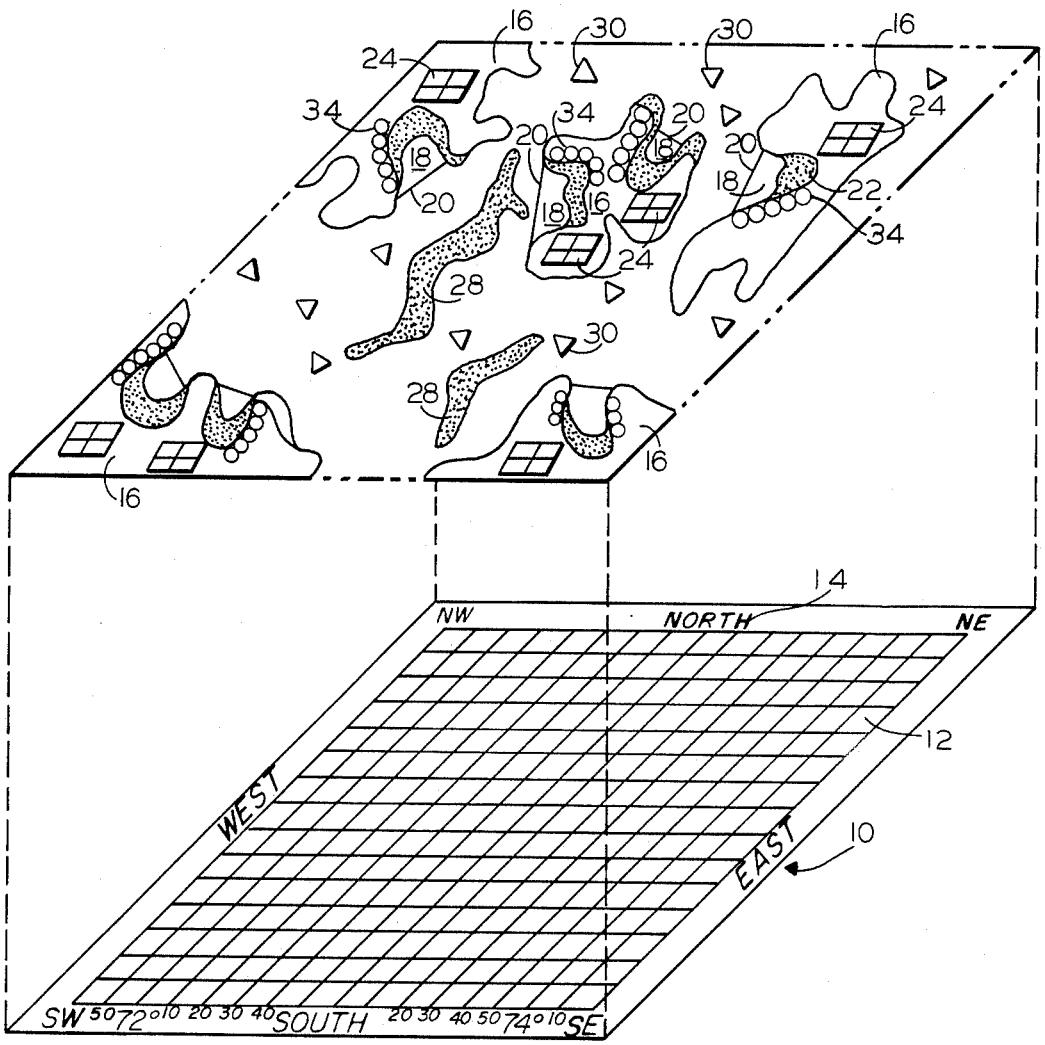

FIG. 1 of the subject invention discloses the game board 10 which is divided into a number of spaces 12 for measuring movement about the board. Along the perimeter of the board are basic compass markings 14, namely north, northeast, east, southeast, south, southwest, west, and northwest. Also as shown in FIG. 1 the various lines on the game board may serve to denote lines of longitude and latitude though use of these indicators is not anticipated in the preferred embodiment of the game.

FIG. 1 also discloses the paraphenalia which is applied to the game board 10.

The land masses 16 are each individually movable and are placed upon the game board in whatever position is desired by the players. Each land mass has at least one harbor 18. The perimeter of the harbor is defined in part by the land mass and in part by a line of demarcation 20 which enables the players to determine which spaces 12 on the game board qualify for being within the harbor 18. Each harbor has a harbor shoal area 22. The harbor shoal areas are all transparent so that the spaces 12 can be seen therethrough.

Figure 2:
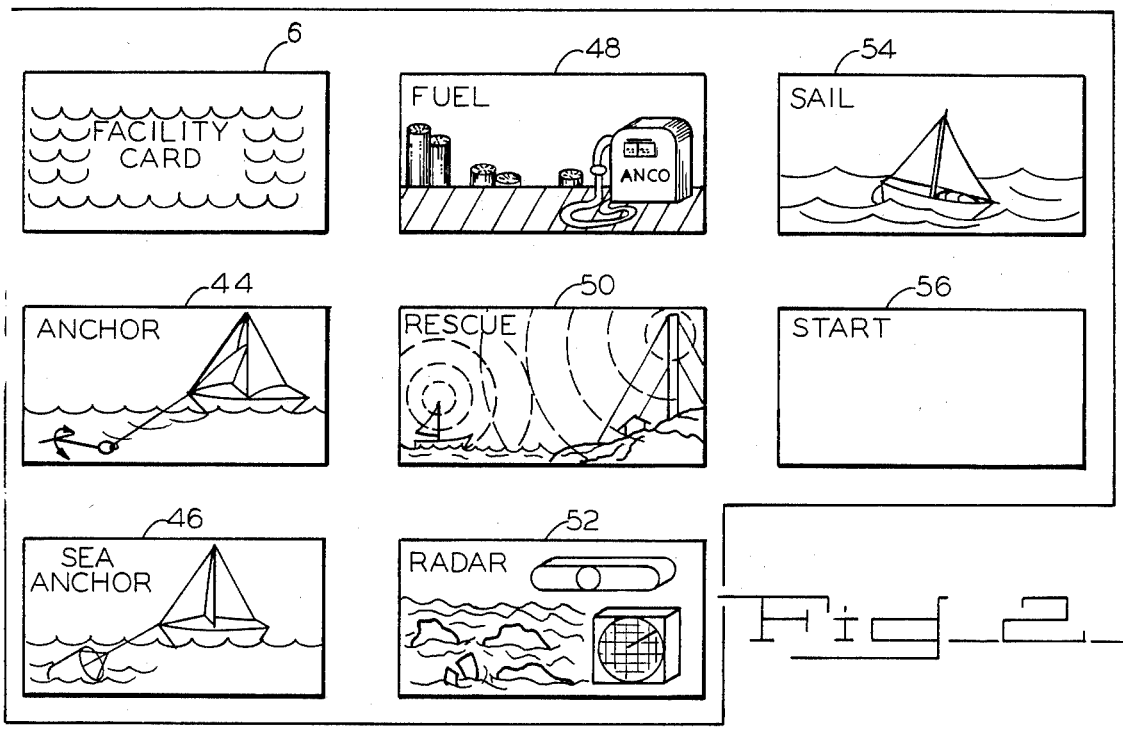
FIG. 2 is a plan view of the various facility cards.

Associated with each harbor is a facility plate 24 which is located next to the harbor to which it is associated and upon a land mass 16. The facility plates serve as positioning areas for placing facility cards 26 which are shown in FIG. 2. Prior to starting the game, the players determine which facility cards will be placed at which harbors such that each harbor does not contain all of the same facilities. The facility cards are placed face up and when a player's playing piece is within the perimeter of the harbor, he may decide to skip a turn which entitles him to choose one of the facility cards 26 related to the harbor 18 in which his game piece resides.

There are two freestranding shoals 28 which are also movable and are positioned upon the game board. The freestanding shoals 28 are also transparent revealing the spaces 12 beneath them.

Figure 6:
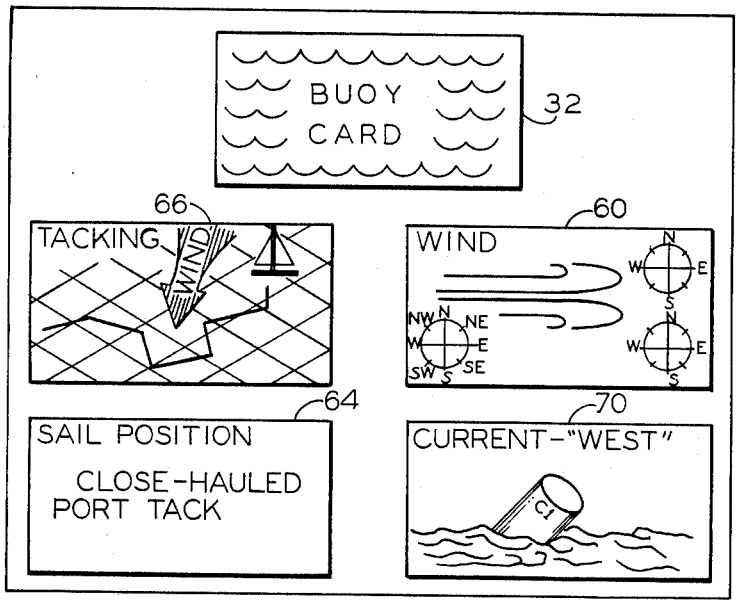
FIG. 6 is a top plan view of the buoy cards used in the game.

Also placed upon the game board are buoys 30. Each of these buoys 30 is placed within a space 12. When a player chooses to land his playing piece upon one of these buoys 30, he becomes entitled to a buoy card 32 as shown in FIG. 6. The buoy cards are not open to the player's inspection and are therefore chosen blindly.

FIG. 1 also discloses tokens 34. These tokens come in sets of different colors and do not appear on the game board at the start of the game. Each player starts the game with a set of colored tokens and places one of his tokens at each of the harbors he enters. Thus, the tokens serve as a tracking means for determining which harbors a player has entered. This is especially important since during the play of the game the harbors do not have to be visited in any predetermined sequence.

Figure 3:
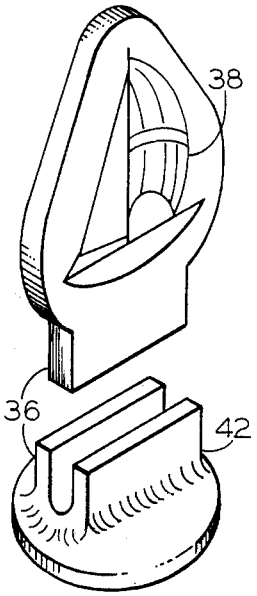
FIG. 3 is a perspective view of the racing boat game piece.
Figure 4:
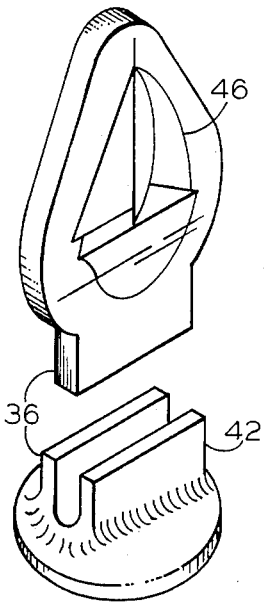
FIG. 4 is a perspective view of the cruising boat game piece.

Prior to starting the game, each player chooses a game piece 36 as shown in FIGS. 3 and 4. At this point, the player has the option of choosing either a racing vessel 38 or a cruising vessel 40. Each of these vessels is supported in a base 42. The bases are of different colors in order to distinguish the players and each base is color related to a set of tokens 34. Each of the vessels have different navigational capabilities with respect to movement about the game board. These differences will be discussed in detail as they relate to other features of the game which are yet to be explained.

FIG. 2 discloses the facility cards 26 which are available. The facility cards consist of anchors 44, sea anchors 46, fuel 48, rescue 50, radar 52, sail 54 and start 56.

The start card 56 is placed at the harbor which is chosen as the starting line and, of course, each player gets one start card. The line of demarcation 20 for the starting harbors serves as the starting and finishing line. Thus, the game involves leaving and returning to one's home harbor.

Having other facility cards, a player on his turn, may play one or more cards as long as they are not contradictory. The anchor 44 allows a player to remain on the same space 12 and thereby forfeit a turn. However, this card cannot be played in a hurricane situation as will be explained later. The sea anchor allows the player to limit his movement to any number of spaces less than the total run which was determined by the windspeed indicator 58 shown in FIG. 7. Fuel 48 allows a player to move up to four spaces in any direction. In order to obtain a fuel card, a player must forfeit two turns while in a harbor having that card at the associated facility plate 24. A rescue card allows a player who becomes shipwrecked by being forced into one of the land masses or onto a shoal, or off the board, to continue to play from the point of wreckage. The radar card allows normal play when the windspeed indicator shown in FIG. 7 indicates that there is a fog condition. The sail card has a different effect depending upon the vessel which the player chooses at the beginning of the game. A player with racing vessel 38 can play a sail card in order to double his move from either a 1 to a 2 or a 2 to a 4 when that move appears on the wind speed indicator 58. A player with a cruising vessel 40 can play the sail card 54 in order to obtain normal play when the windspeed indicator 58 lands on a 9 or a 10. Without a sail card 54, the cruise vessel would remain stationary on a spin of a 9 or a 10 as if the vessel were anchored. Similarly, since the racing vessel 38 cannot navigate in strong wind forces such as a 9 or 10, it must always remain stationary as if anchored.

Figure 5:
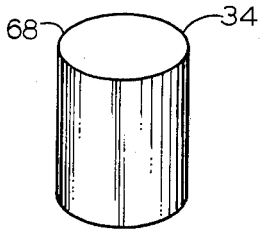
FIG. 5 is an elevational view of one of the game tokens.

FIG. 5 shows a token 34 which is color coded to one of the bases 42 of one of the player's game pieces. These tokens 34 are left by the player at each of the harbors 18 which he enters.

Since it is necessary to enter each harbor, it will be appreciated that by arranging the land masses 16 and the freestanding shoals 28, it is possible to alter the degree of difficulty for entering a harbor. Each of the two different sailing vessels have a different advantage when attempting to enter a harbor. A player using a racing vessel 38 is allowed to move one additional space in any direction, except against the wind, either before or after his normal move. This advantage is offset by the fact that the player using a cruising vessel 40 is able to pass over or land upon either a freestanding shoal 28 or harbor shoal area 22.

FIG. 6 shows the buoy cards 32. A player having one of these cards may play it during his turn, if applicable, in order to alter his movements. The wind card 60 allows a player to change the wind direction as initially determined by wind direction indicator 62 with respect to that player's vessel. If the sail position card 64 matches the direction of the player's turn, it may be played in order to increase the run by one or two extra spaces. The tacking card 66 allows the run to be segmented into a number of different directions, so long as the vessel does not head directly into the wind. The current card 70 lets a player move his vessel two spaces in the direction which is opposite of that upon the card. As previously stated, the buoy cards are obtained when a player lands his vessel upon a buoy 32. These cards may be played during any move so long as they do not conflict with the play of either another buoy card or a facility card.

Figure 7:
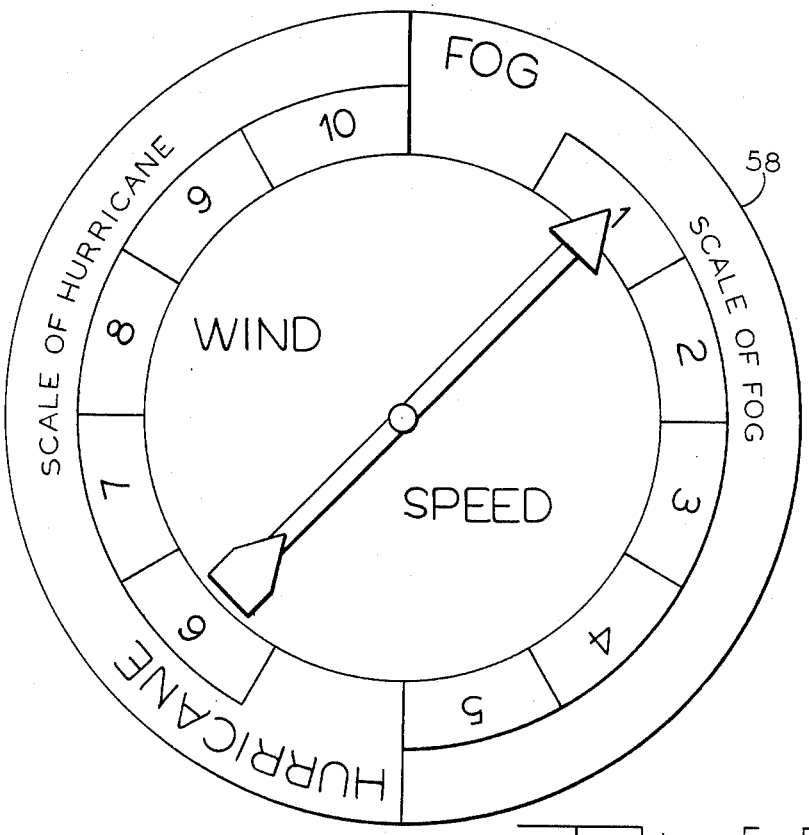
FIG. 7 is a top plan view of the wind speed indicator.
Figure 8:
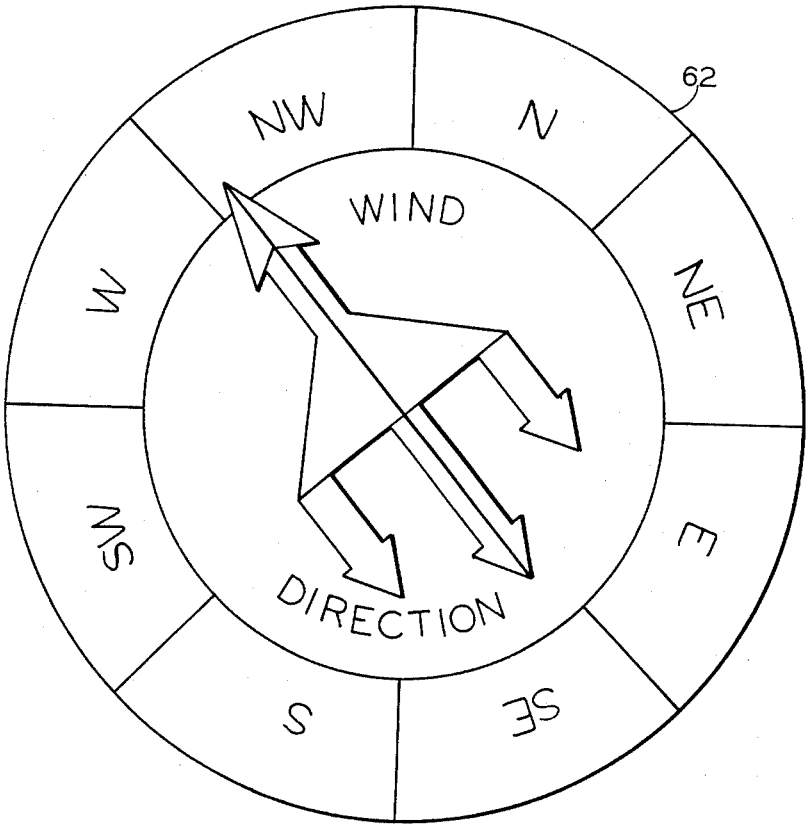
FIG. 8 is a top plan view of the wind direction indicator.

FIG. 7 discloses the wind speed indicator 58. FIG. 8 discloses the wind direction indicator 62. The players take alternate turns spinning both of the indicators 58 and 62 in order to determine the possible directions and magnitudes of piece movements. Each spin of the indicators results in a determination of wind speed and direction which affects all of the vessels on the game board unless a vessel is within a harbor in which case the player has the option of choosing whether or not to be affected by the spins.

After the wind direction and wind speed are determined, each player, starting with the one who spun the indicators, moves his vessel the same number of spaces as indicated on the wind speed indicator 58. The player may move in any direction so long as his vessel does not travel directly into the wind as determined by indicator 62. By playing various facility or buoy cards, a player may alter the effects of the indicators upon his vessel as previously described.

When the wind speed indicator lands on "fog", the indicator is spun again until a numerical value between 1 and 5 is obtained. Thereafter, all players must move either 1 to 5 spaces, depending upon the spin in a direction exactly the opposite to the wind force unless a player has a radar facility card 52. With this radar facility card, the player may treat the fog as he would normal conditions and move the chosen number of spaces in any direction which is not directly into the wind.

Similarly, when the wind speed indicator indicates a "hurricane", the player spins again until a numerical value between 6 and 10 is achieved. The indication of a hurricane suspends the playing of all cards and requires all players, not in a harbor, to move the number of spaces indicated in a direction exactly opposite to the wind, as previously determined by the wind direction indicator 62.

Should a player have his vessel forced off the board or onto land, it is considered to be in a wreckage situation. If the player has a rescue facility card, he may continue to play from the point of the wreckage. However, if there is no rescue facility card, all tokens 34 are reclaimed and the player must start from his home port. Upon starting again from the home port, the player has the option of choosing whether to use a racing vessel 38 or a cruising vessel 40.

Thus, play continues until one player has entered within the perimeter of each harbor and returned to his home harbor, said player being the winner.

Figure 9:
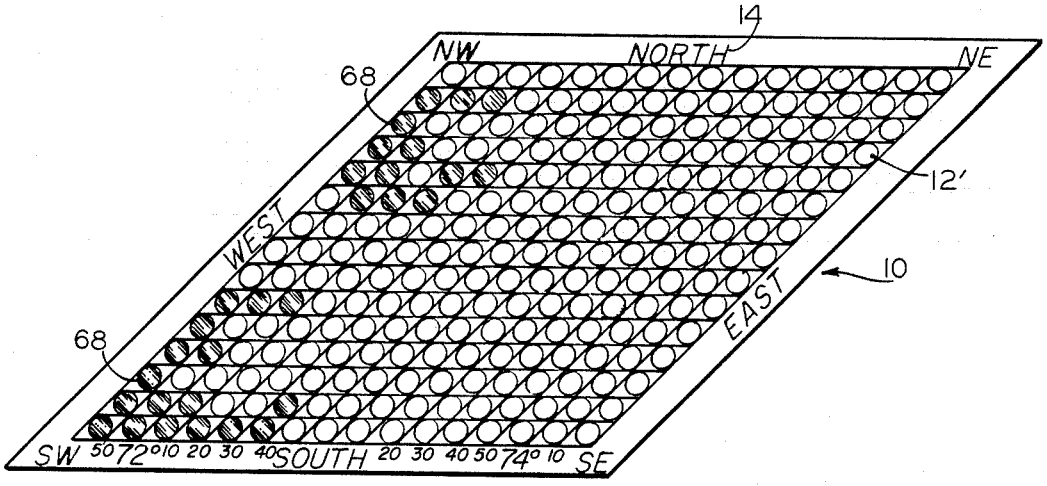
FIG. 9 is a perspective view of an alternate embodiment of the game board where the land masses and harbors are defined by a plurality of markers and the spaces on the game board are receptacles.

In an alternate embodiment of this game, the spaces 12 are actually receptacles. These receptacles receive a set of markers 68, which for intents and purposes, may be the same as the tokens 34, only varying in color. As shown in FIG. 9 markers 68 may be placed within receptacles 12' so as to allow for the virtually infinite variation of marker 68 placements in order to define the land masses and harbors. By arranging the markers 34 within the spaces 12, the players may arrange their own board design. With this embodiment, it is anticipated that prior to starting the game, each player may have the option of moving a predetermined number of markers 68 in order to make the game board more advantageous to the particular type of vessel which the player has previously chosen. For example, a player who has chosen a cruising vessel 40, as opposed to a racing vessel 38, would be more likely to use the allotted number of markers 68 in order to create more and/or larger shoal areas, the types of which are distinguishable from each other by varying the markers 68, since only a cruising vessel 40 is able to pass over or land upon free standing shoals 28 and harbor shoals 22.

This invention in its broader aspects is not limited to the specific embodiments shown and described, but instead, departures may be made therefrom within the scope of the accompanying claims, without departing from the principles of the invention and without sacrificing its chief advantages.

I claim:

1. A sailing game for at least two players comprising:

a game board having a playing surface divided into a predetermined number of spaces;

a plurality of game pieces, one of said pieces to be moved about the game board by each player, each of said pieces having distinguishing indicia thereon, said plurality of game pieces further comprising two distinguishable classes of game pieces consisting of racing game piece vessels which must travel around the shoal areas and cruising game piece vessels which may travel over shoal areas;

a random selection means for determining direction and distance of piece movements on the board;

a plurality of shoal areas, said shoal areas consisting of free standing shoals which may be placed anywhere on the board and harbor shoals which outline the inner surface of each harbor;

a plurality of movable land masses adapted to be placed on the board; and at least one harbor designated on each of the movable land masses, boundaries of said harbors being defined so as to form a perimeter defining a plurality of spaces on the game board that are within each harbor, each of said harbors being located on a portion of the perimeter of a land mass such that the rotational orientation of a land mass changes the position of the designated harbor relative to the game board said harbors defining a general course of play to be followed by the players, each player determining a preferred sequence of harbor stops as the game piece proceeds to each harbor.

2. The invention of claim 1 wherein the spaces on the game board are receptacles and the land masses and harbors are defined by a plurality of markers adapted to be placed within said receptacles.

3. The invention of claim 2 further comprising a group of facility cards, each of said cards having indicia thereon designating an alteration of the effects of the direction and distance randomly selected upon a game piece.

4. The invention of claim 3 further comprising:

a plurality of facility card positioning areas, each of said positioning areas corresponding to one of the harbors, each positioning area adapted to display a selection of facility cards, said selection being less than the complete array of facility card types, the harbors being definable by the facility cards available at each of said harbor, said harbors including;

fuel harbors having fuel facility cards obtainable by players within the fuel harbor, said fuel facility cards enabling a player to move a game piece a predetermined number of spaces in any direction; and anchor harbors having anchor facility cards which enable the card holder/player to reduce the number of spaces his game piece need move during a given turn.

5. The invention of claim 4 further comprising:

a tracking means for recording the harbors each piece has entered, and determining when a player's piece has traveled to each harbor prerequisite to winning the game, and a line of demarcation across each harbor entrance for defining the boundaries of the harbor and establishing when a game piece is within the harbor.

6. The invention of claim 5 wherein said tracking means comprises a plurality of token sets, each set being visually associatable with a game piece, whereby a game piece entering one of the harbors may leave a token from its associated set at said harbor.

7. The invention of claim 6 wherein said random selection means further comprises:

a wind direction indicator to limit the direction in which the pieces are moved; and a movement indicator having a plurality of areas, two of said areas limiting the use of facility cards during the next movement of the pieces, the remaining areas having numbers thereon and indicating varying distances of movement.

* * * * *